US006873244B2

(12) United States Patent
Huang et al.

(10) Patent No.: US 6,873,244 B2
(45) Date of Patent: Mar. 29, 2005

(54) SURFACE MOUNTABLE LAMINATED THERMISTOR DEVICE

(75) Inventors: Chien-Shan Huang, PanChiau (TW); Ren-Haur Hwang, Tao Yuan (TW); Chih-Yi Chang, ChangHua Hsien (TW)

(73) Assignee: Protectronics Technology Corporation, Taoyuan (TW)

( * ) Notice: Subject to any disclaimer, the term of this patent is extended or adjusted under 35 U.S.C. 154(b) by 0 days.

(21) Appl. No.: 10/440,916

(22) Filed: May 19, 2003

(65) Prior Publication Data

US 2003/0227368 A1 Dec. 11, 2003

(30) Foreign Application Priority Data

Jun. 6, 2002 (TW) ..... 91208381 U

(51) Int. Cl.[7] ..... H01C 7/13

(52) U.S. Cl. ..... 338/22 R; 338/22 SD; 338/313; 338/314; 338/328

(58) Field of Search ..... 338/22 R, 22 SD, 338/313, 314, 328

(56) References Cited

U.S. PATENT DOCUMENTS

| | | | | |
|---|---|---|---|---|
| 5,852,397 | A * | 12/1998 | Chan et al. | 338/22 R |
| 6,172,591 | B1 * | 1/2001 | Barrett | 338/22 R |
| 6,377,467 | B1 * | 4/2002 | Chu et al. | 361/767 |
| 6,606,023 | B2 * | 8/2003 | Chiang et al. | 338/22 R |
| 2002/0140540 | A1 * | 10/2002 | Chen et al. | 338/22 R |
| 2002/0162214 | A1 * | 11/2002 | Hetherton et al. | 29/623 |

* cited by examiner

*Primary Examiner*—Karl D. Easthom
(74) *Attorney, Agent, or Firm*—Ladas & Parry LLP

(57) ABSTRACT

The present invention discloses a surface mountable laminated thermistor device which utilizes current-used double sided metal foil clad substrate as a base material and a PTC conductive composite that complies with circuit connection design combinations among electrodes to obtain a surface mountable laminated thermistor device with a parallel manner, and vastly simplify the fabrication process of the surface mountable laminated thermistor device.

19 Claims, 5 Drawing Sheets

SURFACE MOUNTABLE LAMINATED THERMISTOR DEVICE

BACKGROUND OF THE INVENTION

The present invention relates to a surface mountable laminated thermistor device, specifically to a surface mountable laminated thermistor device having a Positive Temperature Coefficient (hereafter referred as PTC) characteristic.

PTC device has been widely applied in the fields of temperature detection, safety control, temperature compensation, etc. In the past, thermistor device was primarily made from ceramics. High temperature is needed in fabricating ceramics and the temperature used in the fabrication process is usually higher than 900 degrees Celsius, which complicates the process and consumes large amount of energy. Polymeric thermistor device was then developed. Since the fabrication temperature for a surface mountable laminated thermistor device with polymer-based material is lower than 300 degree Celsius, it can be understood that the process and formation becomes easier because energy consumption is lesser, fabrication process is simpler and the cost is lowered compared to the fabrication process described previously. Therefore, the application fields are gradually broadened.

The conventional PTC circuit protection device can be made by using polymeric composite materials filled by conductive fillers. It can be applied in the current overloading protection device and the design of the temperature-switching device. This is due to the fact that the conductive filling particles in the polymeric composite material filled by the conductive filler are at the conducting state of connecting to each other at room temperature. When the temperature rises above the switching temperature, the volume of the resin material in the polymeric composite material expands, causing conductive filling particles in the polymeric composite material to transform from the state of connecting to each other to expand to break to become an discontinuous state so as to cause the resistance of the PTC circuit protection device to rise rapidly to cut off the current, thereby achieving the objectives of current overloading protection and temperature-controlled switch. Carbon Black is often used as conductive fillers.

The conventional PTC laminated structure uses the conductive composite material component with a top layer and a bottom layer metal foils and an intermediate layer with the PTC characteristics. It arranges with a lateral conductive mechanism and an insulating material to electrically conduct the top layer and bottom layer metal electrodes of the conductive composite material component with the PTC characteristics to another plane to make the surface mountable circuit protection device.

These techniques mainly adopt the metal foils and the conductive composite material components with the PTC characteristics. The PTC laminated structure is formed after the thermal laminating, then electroplating, etching, plated through hole, and dipping electroplating processes are conducted. First of all, the metal foils, the conductive composite material component with PTC characteristics, and the PTC laminated structure formed by thermal laminating metal foils have insufficient mechanical strength, and are prone to wrapping to deform during the above processes. After circuits are made, thermal laminating of other PTC laminated structures, the insulation reinforcement material or the metal electrode to form multiple-layer PTC laminated structure will cause the problem of how to align top and bottom layers accurately. On the other hand, the technologies described above when use the metal foil and conductive composite material with the PTC characteristics are processed, because of the material is flexible so the shortcomings of possible wrapping during the processing, deformation, poor dimension stability, and uneasy processing are more likely to occur.

In addition, designing a surface mountable laminated thermistor device in a way such that the device having conductive polymeric composite material with PTC characteristics may achieve parallel effect because of circuit connection design combinations when resolving this fabrication and processing problems is also one of the industrial needs. Thus, the application field of surface mountable laminated thermistor device can be broadened.

SUMMARY OF THE INVENTION

One goal of the present invention is to provide a new type of surface mountable laminated thermistor device and its structures different from a surface mountable laminated thermistor device of a prior art by having different electrical characteristics.

Another goal of the present invention is to provide a surface mountable laminated thermistor device with better structure strength, so that processing and fabricating the device becomes simpler, and the problem of dimension stability is reduced.

Furthermore, the current mature fabrication process of the printed-circuit board may be used in manufacturing the surface mountable laminated thermistor device, so that the fabrication and processing for laminated circuit protection device are even easier.

Moreover, another goal of the present invention is to provide a new type of surface mountable laminated thermistor device, wherein the surface mountable laminated thermistor device having PTC conductive composite devices has broader application fields because the design of circuit conduction may achieve parallel connection effects.

To achieve the goals described above, the present invention provides a surface mountable laminated thermistor device, it comprises a first electrode layer, an insulation layer, a first conductive layer, a PTC conductive composite layer, a second electrode layer, and first, second, third, and fourth conductive mechanisms, wherein the first electrode layer comprises a first portion and a second portion, and an insulation is interposed between said first portion and second portion. Said insulation layer is disposed under said first electrode layer, and said first conductive layer is disposed under said insulation layer. Said first conductive layer comprises a first conductive part and a second conductive part separated by insulation, and the minimum distance between said first conductive part and second conductive part is greater than the thickness of said PTC conductive composite layer so that most of the current cannot laterally flow into said second conductive part via said first conductive part. Said PTC conductive composite layer is disposed under said first conductive layer. Said second electrode layer is disposed under said PTC conductive composite layer, and said second electrode layer comprises a first portion and a second portion, wherein the minimum distance between said first portion of second electrode layer and said second portion of second electrode layer is greater than the thickness of said PTC conductive composite layer, allowing the resistance of said first portion of second electrode layer and said second portion of second electrode layer to be greater than the resistance of said PTC conductive composite layer such that most of the current cannot laterally flow into said second portion of second electrode layer via said first portion of second electrode layer. Said first conductive mechanism is interposed between said first conductive part of first conductive layer and said second portion of first electrode so that said first conductive part of first conductive layer may pass through said insulation layer to form electrical conduction with said second portion of first electrode. Said second conductive mechanism is interposed between said second conductive part of first conductive layer and said first portion of first electrode so that said second conductive part of first conductive layer may pass through said insulation layer to form electrical conduction with said first portion of first electrode. Third conductive mechanism passes through said PTC conductive composite layer and said insulation layer so that said first portion of second electrode layer can form electrical conduction with said first portion of first electrode layer. Lastly, fourth conductive mechanism passes through said PTC conductive composite layer and the insulation layer so that the second portion of second electrode layer can form electrical conduction with said second portion of first electrode layer.

In accordance with the circuit connection design described above, there are two ways for current to flow from the first portion of first electrode to second portion of first electrode. In the first way, the current flows from the first portion of first electrode layer to first portion of second electrode layer by way of the third conductive mechanism, then flows to the first conductive part of first conductive layer by way of the PTC conductive composite layer, and finally flows to the second portion of first electrode layer by way of the first conductive mechanism. In the second way, the current flows from the first portion of first electrode layer to second portion of first electrode layer by way of the second conductive mechanism, then flows to the second portion of second electrode layer by way of the PTC conductive composite layer, and finally flows to the second portion of first electrode layer by way of the fourth conductive mechanism. Therefore, the surface mountable laminated thermistor device of the present invention obtains broader application fields because the design of circuit conduction can achieve parallel connection effects, wherein the surface mountable laminated thermistor device has PTC conductive composite devices.

Furthermore, the connected first electrode layer, insulation layer, and first conductive layer are replaced by double-sided metal foil so that the existing mature printed circuit board processing can be used. Therefore, processing and manufacturing of the surface mountable laminated thermistor device become simpler and easier.

In addition, the insulation layer of the double-sided metal foil is an insulation-reinforced layer, which may have better structure strength and better dimension stability.

Other advantages of the present invention and further details will be described with the following embodiments.

DETAILED DESCRIPTION OF THE PREFERRED EMBODIMENT

Figure 1:
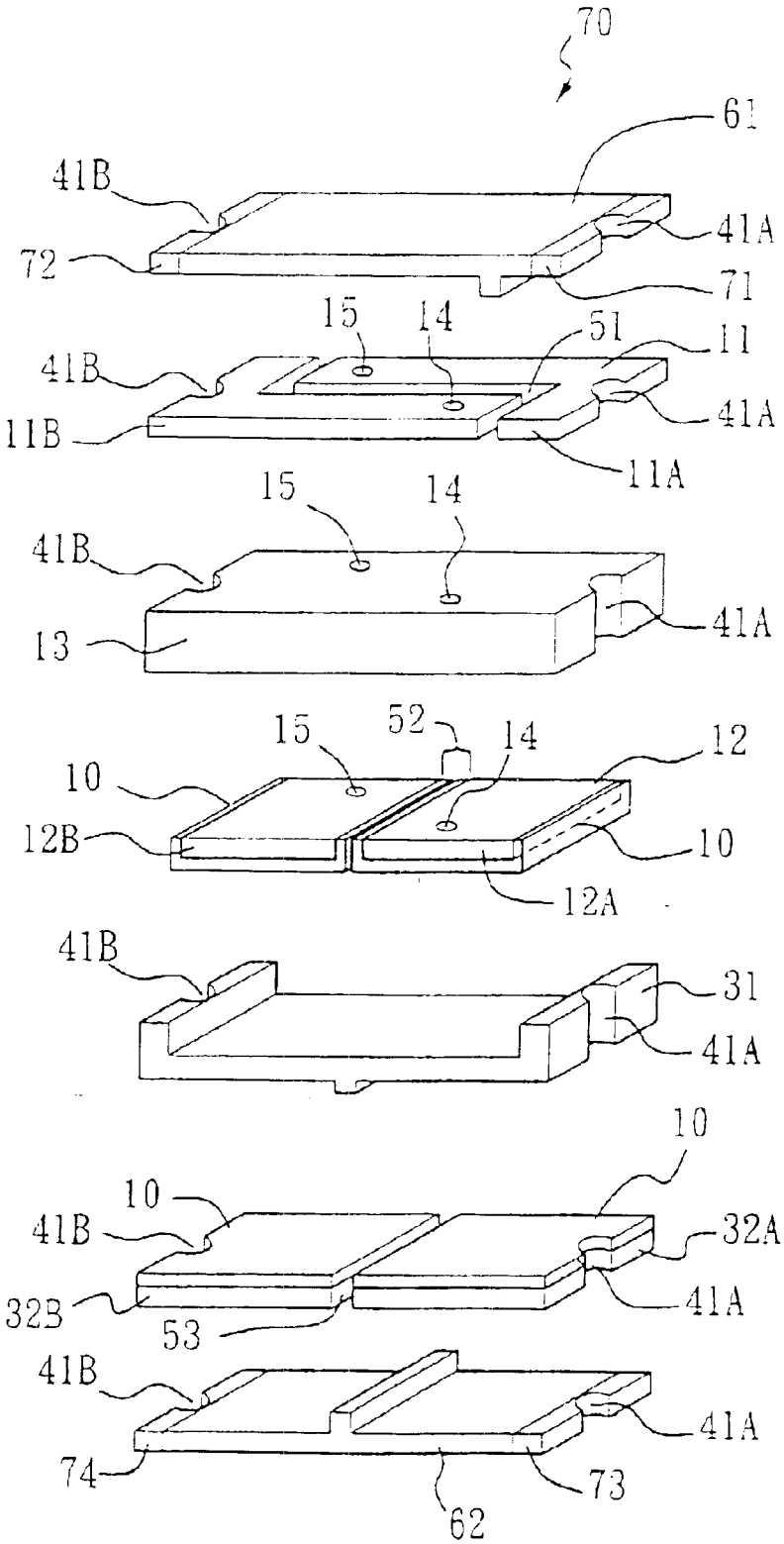
FIG. 1 is a device break down figure of an embodiment of the present invention.

Please refer to FIGS. 1 and 2. The first embodiment of the present invention discloses a surface mountable laminated thermistor device 70 which comprises a first electrode layer 11, a first insulation layer 13, a first conductive layer 12, a PTC conductive composite layer 31, a second electrode layer 32, a second insulation layer 61, a third insulation layer 62, a first conductive mechanism 15, a second conductive mechanism 14, a third conductive mechanism 41B, and a fourth conductive mechanism 41A. First electrode layer 11 comprises a first portion 11B and a second portion 11A, and a first isolation trench 51 is interposed between first portion 11B and second portion 11A so that it is insulated between first portion 11B and second portion 11A. Insulating materials can be filled in the first isolation trench 51 to consolidate device and ensure insulation. A second insulation layer 61 is disposed above first electrode layer 11, and a first insulation layer 13 is disposed under first electrode layer 11.

A first conductive layer 12, a PTC conductive composite layer 31, a second electrode layer 32, and a third insulation layer 62 are disposed sequentially under first insulation layer 13, wherein the combination of the first conductive layer 12 and the PTC conductive composite layer 31, or the combination of the second electrode layer 32 and the PTC conductive composite layer 31 may use electroplating process with carbon black composite such that a composite electroplating layer 10 of continuous porous structure with carbon black and metal is formed between PTC conductive composite layer 31 and first conductive layer 12 or second electrode layer 32. Having the continuous porous structure, the metal electrodes and PTC conductive composite layer may form good adhesion with less interface resistance.

Said PTC conductive composite layer 31, in this embodiment, is conductive crystallized composite filled with carbon black. The crystallized materials can be polyethylene, polypropylene, polyvinyl fluoride, and their copolymers. The carbon black uses carbon black Raven450 (a product of U.S. Columbian corporation). In this embodiment, carbon black and crystallized polymer are mixed in a 1:1 ratio by weight and incorporated into a brabender mixer at 210° C. for 8 minutes, then thermally laminated with a heated press at 175° C. to form PTC plate conductive composite with about 0.5 mm in thickness The selection of PTC conductive composite can be easily obtained by people who are familiar with this art, and is not the characteristics of the present invention.

A second isolation trench 52 is disposed on the first conductive layer 12, and a third isolation trench 53 is disposed on the second electrode layer 32 such that the first conductive layer 12 and second electrode layer 32 are divided into two insulating portions, wherein the first conductive layer 12 comprises a first conductive part 12B and a second conductive part 12A. The second electrode layer 32 consists of a first portion 32B and a second portion 32A. That is, the first conductive part 12B and said second conductive part 12A of the first conductive layer 12 are the insulating state. In addition, insulating state is between the first portion 32B and second portion 32A of second electrode layer 32 too. Third isolation trench 53 may be filled with insulating material.

The minimum distance of the first conductive part 12B and second conductive part 12A of said first conductive layer 12 is greater than the thickness of the PTC conductive composite layer 31 such that most of the current cannot laterally flow into said second conductive part 12A via said first conductive part 12B.

The distance between the first portion 32B of said second electrode layer and said second portion 32A of second electrode layer is greater than the thickness of the PTC conductive composite layer 31. In addition, the minimum distance between said first portion 32B of second electrode layer and said first conductive part 12B of first conductive layer, and the minimum distance between said second portion 32A of second electrode layer and said second conductive part 12A of first conductive layer are both smaller than the distance between said first portion 32B of second electrode layer and said second portion 32A of second electrode layer. The resistance between said first portion 32B of second electrode layer and said second portion 32A of second electrode layer is therefore greater than the resistance of the PTC conductive composite such that current cannot laterally flow into second portion 32A of second electrode layer by way of the first portion 32B of second electrode layer.

Figure 2A:
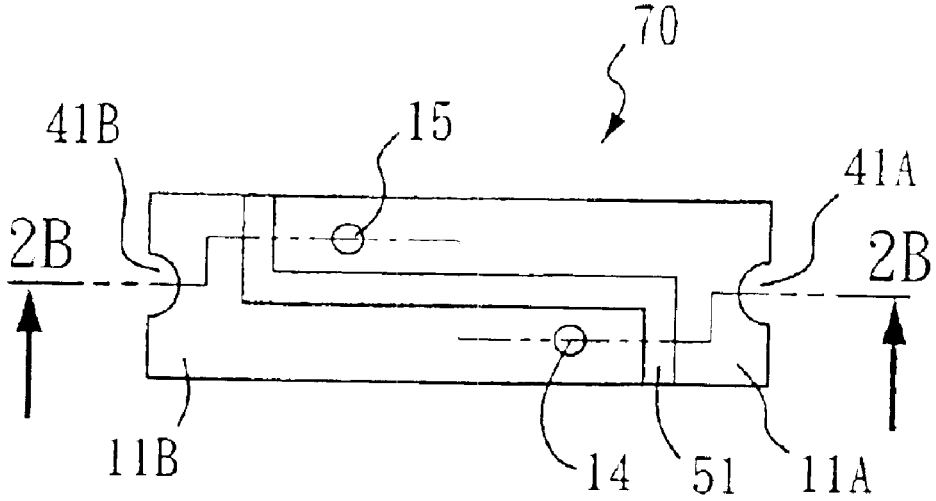
FIG. 2A is a top view below the first electrode layer.
Figure 2B:
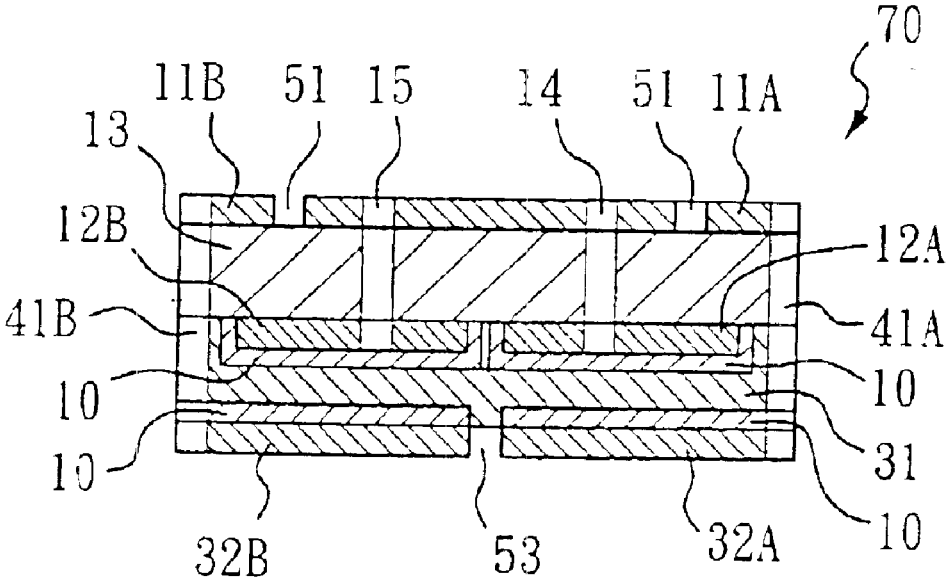
FIG. 2B is a profile figure along line 2B2B line of the above embodiment.

Please refer to FIGS. 2A and 2B. According to the figure, first portion 32B of second electrode layer 32 is disposed under PTC conductive composite layer 31, and second portion 32A of second electrode layer 32 is also disposed under PTC conductive composite layer 31. That is, the sequence on one flank of the second isolation trench 52 and third isolation trench 53, from top to bottom, is first conductive part 12B of first conductive layer 12, PTC conductive composite layer 31, and first portion 32B of second electrode layer 32. The other flank of the second isolation trench 52 and third isolation trench 53, from top to bottom, is second conductive part 12A of first conductive layer 12, PTC conductive composite layer 31, and second portion 32A of second electrode layer 32.

First conductive mechanism 15 is interposed between the first conductive part 12B of first conductive layer 12 and the second portion 11A of first electrode 11 such that the first conductive part 12B of first conductive layer 12 can pass through said first insulation layer 13 to electrically connect to the second portion 11A of first electrode 11.

Second conductive mechanism 14 is interposed between the second conductive part 12A of first conductive layer 12 and the first portion 11B of first electrode 11 such that the second conductive part 12A of first conductive layer 12 can pass through said first insulation layer 13 to electrically connect to the first portion 11B of first electrode 11.

Figure 3:
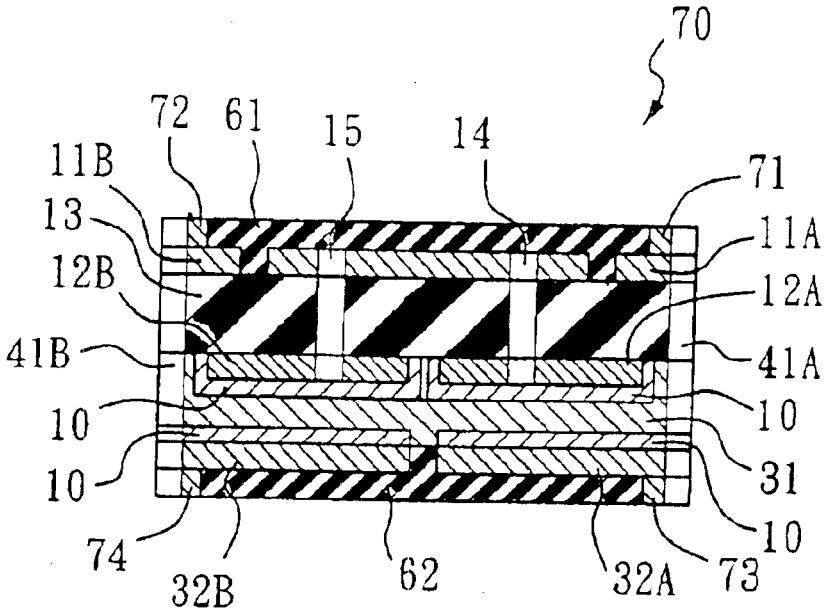
FIG. 3 is a profile figure along line 2B2B of the above embodiment.

Please refer to FIG. 3. Third conductive mechanism 41B passes through PTC conductive composite layer 31 and first insulation layer 13 such that the first portion 32B of second electrode layer 32 can electrically connect to the first portion 11B of first electrode layer 11. Fourth conductive mechanism 41A passes through PTC conductive composite layer 31 and first insulation layer 13 such that the second portion 32A of second electrode layer 32 can electrically connect to the second portion 11A of first electrode layer 11.

End electrodes 72, 71, 74, 73 are disposed on the first portion 11B and second portion 11A of first electrode layer 11, and the first portion 32B and second portion 32A of second electrode layer 32 respectively.

Figure 4:
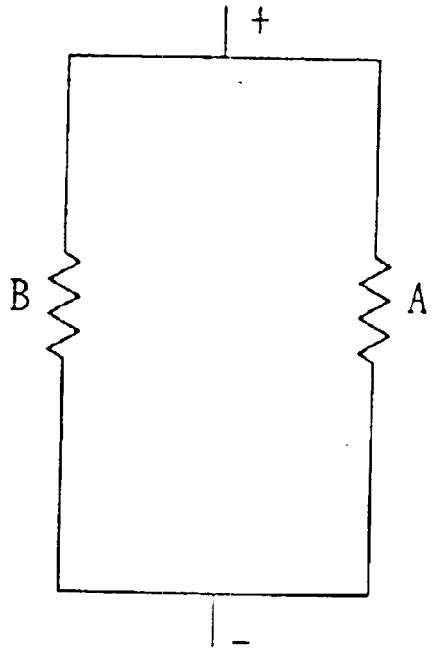
FIG. 4 is a circuit diagram of the above embodiment.

Please refer to FIG. 4. This is a schematic circuit diagram of this embodiment. Because the minimum width of the second isolation trench 52 and third isolation trench 53 are both greater than the thickness of the PTC conductive composite layer 31, and the insulation layer whose resistance is far greater than the resistance of PTC conductive composite is disposed on the third isolation trench 53, current cannot laterally flow into said second conductive part of the first conductive layer by way of the first conductive part of first conductive layer, or laterally flow into the second portion of second electrode layer by way of the first portion of second electrode layer, that is, operating in parallel shown in the figure.

In this embodiment, the first conductive mechanism 15, second conductive mechanism 14, third conductive mechanism 41B, and fourth conductive mechanism 41A are Plated-Through-Holes (PTHs), and any kind of conductive materials are applicable, wherein copper, nickel, silver, gold, zinc, tin and any metal alloy thereof are preferable. For the third conductive mechanism 41B and fourth conductive mechanism 41A, because they are located at the flank, the method of plated-through-holes is not necessary. Instead, ceramic passive device is used to fabricate the end electrodes on two sides (not shown) after they have been cut into duplicated sized polymeric substrate circuit protection device.

Solder mask is used for the second insulation layer 61 and third insulation layer 62 in this embodiment. The solder mask is further filled into the first isolation trench 51 and third isolation trench 53 to simplify the fabrication process.

Figure 5:
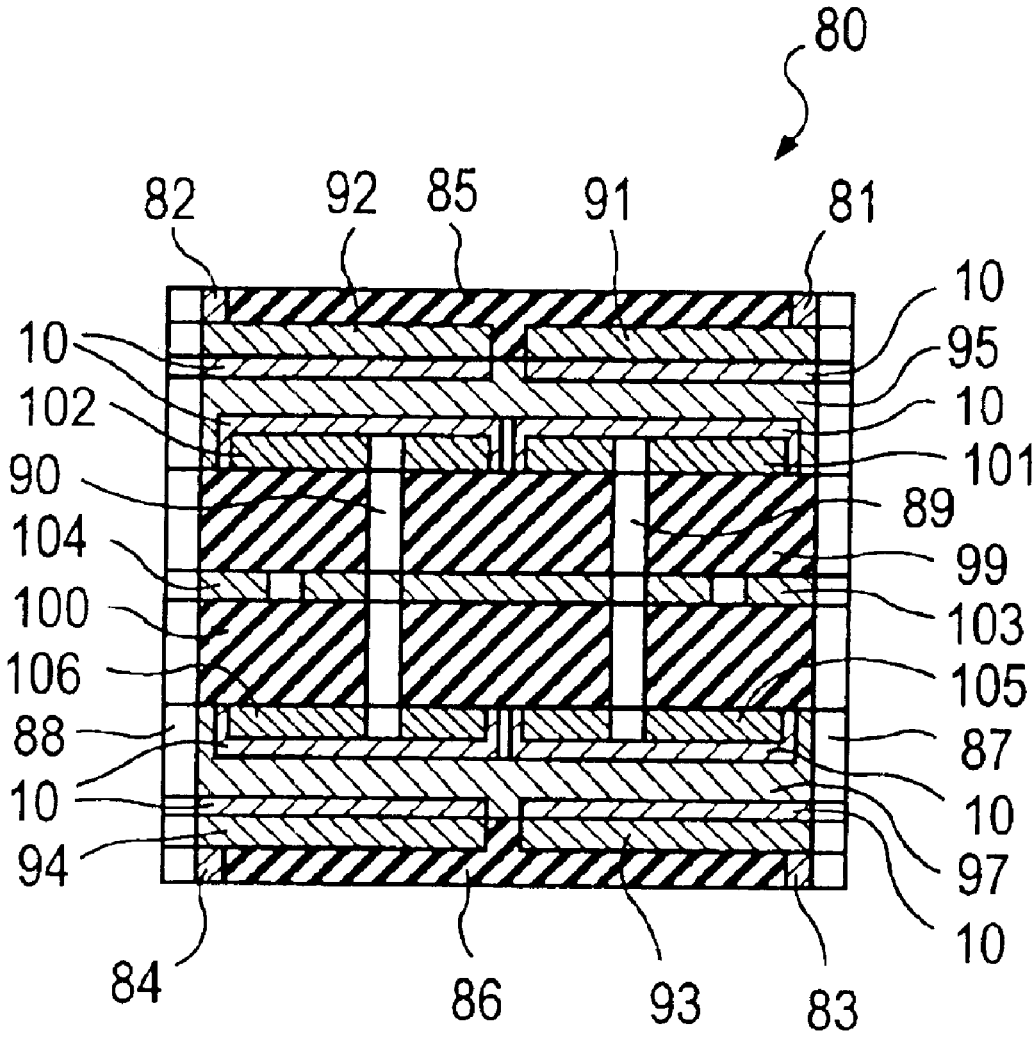
FIG. 5 is a profile figure of another embodiment of the present invention.
Figure 6:
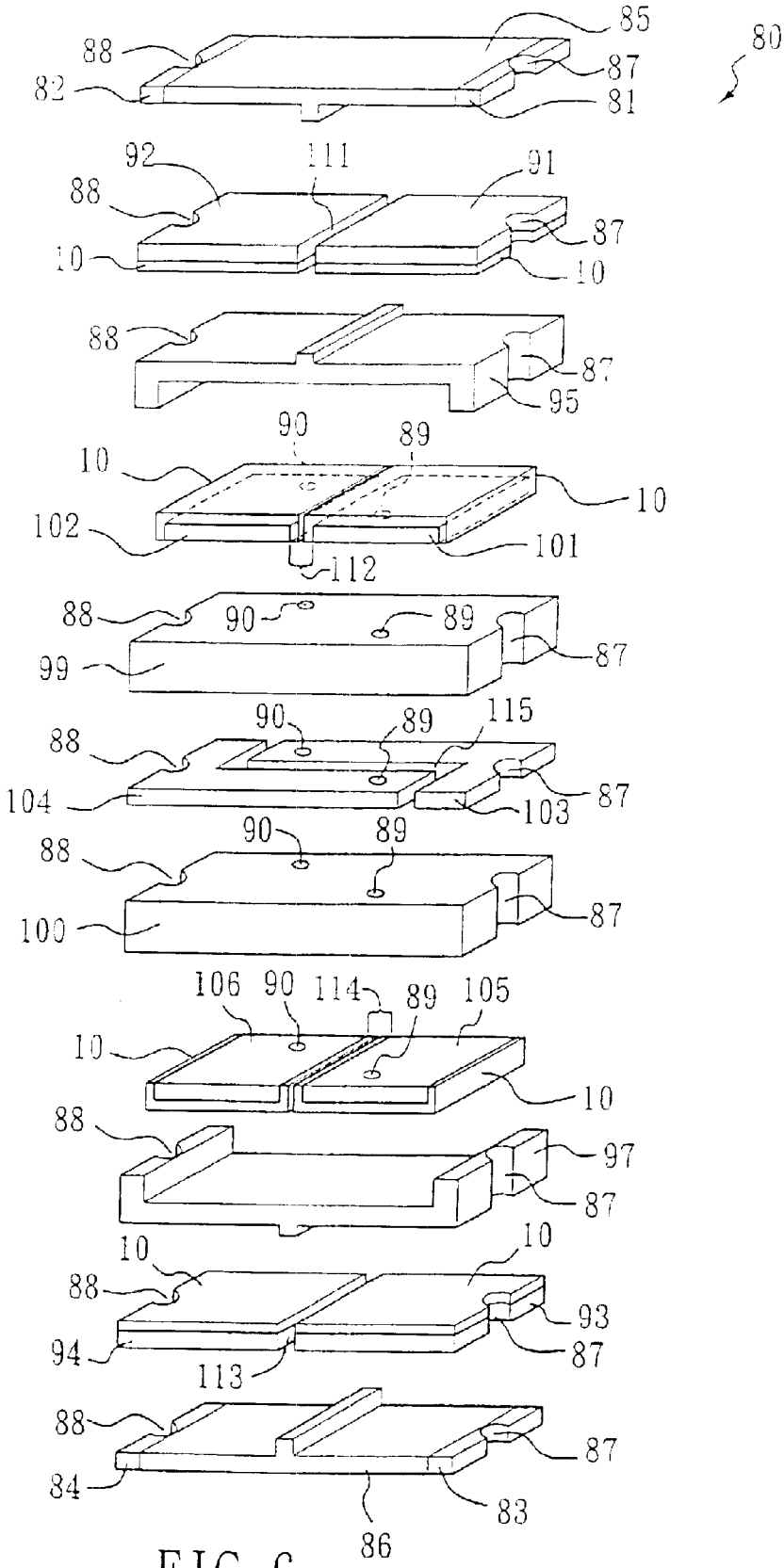
FIG. 6 is a device break down figure of the above embodiment of the present invention.

Please refer to FIG. 5 and FIG. 6, which refer to the second embodiment of the present invention that utilizes and combines two devices of the previous embodiment where the original first electrode layer is oriented inside. FIG. 6 discloses break down details of the device. This embodiment can further produce parallel effect on surface mountable laminated thermistor device.

According to the previous embodiments, the present invention provides a new type of surface mountable laminated thermistor device whose structure is different from the surface mountable laminated thermistor device of the prior art so that it achieves different electrical characteristics. And in accordance with those embodiments, current flowing from first portion 11B of first electrode 11 to second portion 11A of first electrode 11 may flow through two paths: In the first path, the current may flow from the first portion 11B of first electrode layer 11 to the first portion 32B of second electrode layer 32 by way of the third conductive mechanism 41B, then flow to the first conductive part 12B of first conductive layer 12 by way of the PTC conductive composite layer 31, and finally to the first portion 11A of first electrode layer 11 by way of the first conductive mechanism 15. In the second path, the current may flow from the first portion 11B of first electrode layer 11 to the second conductive part 12A of first electrode layer 12 by way of the second conductive mechanism 14, then flow to the second portion 32A of second electrode layer 32 by way of the PTC conductive composite device 31, and finally to the second portion 11A of first electrode layer 11 by way of the fourth conductive mechanism 41A. Therefore, the surface mountable laminated thermistor device of the present invention obtains broader application fields because the design of circuit conduction can achieve parallel connection effects, wherein the surface mountable laminated thermistor device has PTC conductive composite element 31.

Double-sided metal foil clad substrate is used in manufacturing to connect the first electrode layer 11, first insulation layer 13, and first conductive layer 12. Meanwhile, in the present embodiment, double-sided metal foil clad substrate such as copper foil electrode with about 35 μm in thickness is used. Therefore, the existing mature printed circuit board fabrication can be used in processing and fabricating surface mountable laminated thermistor device, making it easier and simpler. Furthermore, the insulation reinforced layer of the double-sided metal foil clad substrate can be an epoxy resin layer, a polyimide resin layer, a laminated material layer formed by glass cloth impregnated with epoxy resin, or a laminated material layer formed by glass cloth impregnated with polyimide. In the present embodiment, a prepreg material, such as a glass cloth impregnated with epoxy resin, is used as insulation reinforced layer to achieve better structure strength and better dimension stability so that the quality and accuracy for fabricated surface mountable laminated thermistor device are better.

Although the present invention is described using the above embodiments, it does not mean that the scope of the present invention is limited to the above description. Persons skilled in the art can make all kinds of modifications, for example, changing the selected polymeric material, introducing different conductive particles, changing electroplating conditions, changing constituent weight ratio, to achieve the same effects. However, these modifications shall not deviate from the spirit of the present invention, and they still belong to the protective scope of the present invention. The protective scope of the present invention shall be limited to the description of the claims.

Reference Numerals of Major Parts

| | |
|---|---|
| 10 | composite electroplating layer |
| 11 | first electrode layer |
| 11A | second portion of first electrode layer |
| 11B | first portion of first electrode layer |
| 12 | first conductive layer |
| 12A | second conductive part of first conductive layer |
| 12B | first conductive part of first conductive layer |
| 13 | first insulation layer |
| 14 | second conductive mechanism |
| 15 | first conductive mechanism |
| 31 | PTC conductive composite layer |
| 32 | second electrode layer |
| 32A | second portion of second electrode layer |
| 32B | first portion of second electrode layer |
| 41A | fourth conductive mechanism |
| 41B | third conductive mechanism |
| 51 | first isolation trench |
| 52 | second isolation trench |
| 53 | third isolation trench |
| 61 | second insulation layer |
| 62 | third insulation layer |
| 70 | laminated thermistor device of first embodiment of the present invention |
| 71, 72, 73, 74 | end electrode |
| 80 | laminated thermistor device of another embodiment of the present invention |
| 81, 82, 83, 84 | end electrode |
| 85, 86 | insulated solder mask |
| 87 | third conductive mechanism |
| 88 | fourth conductive mechanism |
| 89 | first conductive mechanism |
| 90 | second conductive mechanism |
| 91 | first portion of first electrode |
| 92 | second portion of first electrode |
| 93 | first portion of second electrode |
| 94 | second portion of second electrode |
| 95 | first PTC conductive composite layer |
| 97 | second PTC conductive composite layer |
| 99 | first insulation layer |
| 100 | second insulation layer |
| 101 | first conductive part of first conductive layer |
| 102 | second conductive part of first conductive layer |

-continued

| | |
|---|---|
| 103 | first conductive part of second conductive layer |
| 104 | second conductive part of second conductive layer |
| 105 | first conductive part of third conductive layer |
| 106 | second conductive part of third conductive layer |
| 111 | first isolation trench |
| 112 | second isolation trench |
| 113 | third isolation trench |
| 114 | fourth isolation trench |
| 115 | fifth isolation trench |

What is claimed is:

1. A surface mountable laminated heat sensitive impedance device comprising:

a first electrode layer comprising a first means and a second means and being electrically insulated between therein;

an electrically insulating layer disposed under said first electrode layer;

a first conductive layer disposed under said electrically insulating layer and comprising a first conductive part and a second conductive part and being electrically insulated between therein;

a first conductive means being interposed between said first conductive part of said first conductive layer and said second means of said first electrode to allow said first conductive part of said first conductive layer to extend through said electrically insulating layer and conductive with said second means of said first electrode;

a second conductive means interposed between said second conductive part of said first conductive layer and said first means of said first electrode to allow said second conductive part of said first conductive layer to extend through said electrically insulating layer and being conductive with said first means of said first electrode;

a PTC conductive polymer disposed under said first conductive layer;

a second electrode layer comprising a first means and a second means and being electrically insulated between therein; the distance between said first means of said second electrode and said second means of said second electrode being greater than the thickness of said PTC conductive polymer; and the minimum distance between said first means of said second electrode and said first conductive part of said first conductive layer and the minimum distance between said second means of said second electrode and said second conductive part of said first conductive layer are both less than the distance between said first means of said second electrode and said second means of said second electrode;

a third conductive means extending through said PTC conductive polymer and said electrically insulating layer to allow said first means of said second electrode layer to be conductive with said first means of said first electrode layer; and a fourth conductive means extending through said PTC conductive polymer and said electrically insulating layer to allow said second means of said second electrode layer to be conductive with said second means of said first electrode layers, wherein the first conductive means and the third conductive means are separated, and the second conductive means and the fourth conductive means are separated.

2. The surface mountable laminated heat sensitive impedance device of claim 1, wherein said first conductive means and said second conductive means are plated-through-hole (PTH).

3. The surface mountable laminated heat sensitive impedance device of claim 1, wherein said first means of said first electrode layer and said second means of said first electrode layer are electrically insulated separately by a first slot filled with electrically insulating fillings.

4. The surface mountable laminated heat sensitive impedance device of claim 1, wherein said first conductive part of said first conductive layer and said second conductive part are electrically insulated separately by a second slot filled with electrically insulating fillings.

5. The surface mountable laminated heat sensitive impedance device of claim 1, wherein said first means of said second electrode layer and said second means are electrically insulated separately by a third slot filled with electrically insulating fillings.

6. The surface mountable laminated heat sensitive impedance device of claim 1, wherein said PTC conductive polymer is a conductive crystalline polymer compound material filled with carbon black.

7. The surface mountable laminated heat sensitive impedance device of claim 6, wherein said crystalline polymer compound material is selected from at least one element in the group consisting of polyethylene, polypropylene, polyvinylfluoride, their copolymer and any combination thereof.

8. The surface mountable laminated heat sensitive impedance device of claim 6, wherein a compound electroplating layer with continuous multi-hole structure comprising carbon black and metal exists between said first conductive layer and said PTC conductive polymer.

9. The surface mountable laminated heat sensitive impedance device of claim 6, wherein a compound electroplating layer with continuous multi-hole structure comprising carbon black and metal exists between said second electrode layer and said PTC conductive polymer.

10. The surface mountable laminated heat sensitive impedance device of claim 1, wherein a second electrically insulating solder mask layer is disposed above said first electrode layer and a second electrically insulating solder mask layer is disposed under said second electrode layer.

11. The surface mountable laminated heat sensitive impedance device of claim 1, wherein each said first means and said second means of said first electrode layer is disposed on an end electrode respectively.

12. The surface mountable laminated heat sensitive impedance device of claim 1, wherein each said first means and said second means of said second electrode layer is disposed on an end electrode respectively.

13. A circuit protection device comprising:

a first electrode layer;

an electrically insulating layer;

a first conductive layer;

a PTC conductive polymer;

a second electrode layer; and a first conductive means, a second conductive means, a third conductive means, and a fourth conductive means;

said circuit protection device from top to bottom consists of said first electrode layer, said electrically insulating layer, said first conductive layer, said PTC conductive layer, and said second electrode layer; an upper slot being disposed on said first electrode layer such that said first electrode layer is divided into a first means and a second means being electrically insulated between therein;

a middle slot disposed on said first conductive layer such that said first conductive layer is divided into an electrically insulating first conductive part and second conductive part;

a lower slot disposed on said second electrode layer such that said second electrode layer is divided into an electrically insulating first means and second means; the minimum width of said lower slot being greater than the width of said PTC conductive polymer;

said first conductive means interposed between said first conductive part of said first conductive layer and said second means of said first electrode such that said first conductive part of said first conductive layer is able to extend through said electrically insulating layer and be electrically connected to said second means of said first electrode;

said second conductive means interposed between said second conductive part of said first conductive layer and said first means of said first electrode such that said second conductive part of said first conductive layer is able to extend through said electrically insulating layer to be electrically connected to said first means of said first electrode;

said third conductive means extending through a PTC conductive polymer and said electrically insulating layer such that said first means of said second electrode layer is able to be electrically connected to said first means of said first electrode layer, but said third conductive means not physically contacting said first conductive part of said first conductive layer; and said fourth conductive means extending through a PTC conductive polymer and said electrically insulating layer such that said second means of said second electrode layer is able to be electrically connected to said second means of said first electrode layer, but said fourth conductive means not physically contacting said second conductive part of said first conductive layer.

14. The protection circuit of claim 13, wherein said PTC conductive polymer is a conductive crystalline polymer compound material filled with carbon black.

15. The protection circuit of claim 13, wherein said crystalline polymer compound material is selected from at least one element in the group comprising polyethylene, polypropylene, polyvinyl fluoride, their copolymer and any combination thereof.

16. A circuit protection device comprising:

a first electrode layer;

a first conductive layer;

a PTC conductive polymer;

a second electrode layer; and a first conductive means, a second conductive means, a third conductive means, and a fourth conductive means;

said circuit protection device from top to bottom consists of said first electrode layer, said electrically insulating layer, said first conductive layer, said PTC conductive polymer, said second electrode layer, and a compound electroplated layer with continuous multi-hole structure comprising carbon black and metal between said first conductive layer and said PTC conductive polymer; an upper slot being disposed on said first electrode layer such that said first electrode layer is divided into a first means and a second means being electrically insulated between therein;

a middle slot disposed on said first conductive layer such that said first conductive layer is divided into an electrically insulating first conductive part and second conductive part;

a lower slot disposed on said second electrode layer such that said second electrode layer is divided into an electrically insulate first means and second means; the minimum width of said lower slot being greater than the width of said PTC conductive polymer;

said first conductive means interposed between said first conductive part of a conductive layer and said second means of said first electrode said that said first conductive part of said first conductive layer is able to extend through said electrically insulating layer and be electrically connected to said second means of said first electrode;

said second conductive means interposed between said second conductive part of said first conductive layer and said first means of said first electrode such that said second conductive part of said first conductive layer is able to extend through said electrically insulating layer to be electrically connected to said first means of said first electrode;

said third conductive means extending through a PTC conductive polymer and said electrically insulating layer such that said first means of said second electrode lay is able to be electrically connected to said first means of said first electrode layer, but said third conductive means not physically contacting said first conductive part of said first conductive layer; and said fourth conductive means extending through a PTC conductive polymer and said electrically insulating layer such that said second means of said second electrode layer is able to be electrically connected to said second means of said first electrode layer, but and fourth conductive means not physically contacting said second conductive part of said first conductive layer.

17. A circuit protection device comprising:

a first electrode layer;

an electrically insulating layer;

a first conductive layer;

a PTC conductive polymer;

a second electrode layer; and a first conductive means, a second conductive means, a third conductive, means and a fourth conductive means;

said circuit protection device from top to bottom consists of said first electrode layer, said electrically insulating layer, said first conductive layer, said PTC conductive polymer, said second electrode layer, and a compound electroplated layer with continuous multi-hole structure comprising carbon black and metal between said second electrode layer and said PTC conductive polymer; an upper slot being disposed on said first electrode layer such that said first electrode layer is divided into a first means and a second means being electrically insulated between therein;

a middle slot disposed on said first conductive layer such that said first conductive layer is divided into an electrically insulating first conductive part and second conductive part;

a lower slot disposed on said second electrode layer such that said second electrode layer is divided into an electrically insulating first means and second means; the minimum width of said lower slot being greater than the width of said PTC conductive polymer;

said first conductive means interposed between said first conductive part of aid first conductive layer and said second means of said first electrode such that said first conductive part of said first conductive layer is able to extend through said electrically insulating layer and be electrically connected to said second means of said first electrode;

said second conductive means interposed between said second conductive part of said first conductive layer and said first means of said first electrode such that said second conductive part of said first conductive layer is able to extend through said electrically insulating layer to be electrically connected to said first means of said first electrode;

said third conductive means extending through a PTG conductive polymer and said electrically insulating layer such that said first means of said second electrode layer is able to be electrically connected to said first means of said first electrode layer, but said third conductive means not physically contacting said first conductive part of said first conductive layer; and said fourth conductive means extending through a PTC conductive polymer and said electrically insulation layer such that said second means of said second electrode layer is able to be electrically connected to said second means of said first electrode layer, but said fourth conductive means not physically contacting said second conductive part of said first conductive layer.

18. The protection circuit of claim 13, wherein each said first means and said second means of said first electrode layer is disposed on an en electrode respectively.

19. The protection circuit of claim 13, wherein each said first means and said second means of said second electrode layer is disposed on an end electrode respectively.

* * * * *